United States Patent [19]

Tung

[11] Patent Number: 5,029,596

[45] **Date of Patent: * Jul. 9, 1991**

[54] STEPLESS TILTING DEVICE FOR UMBRELLA

[76] Inventor: Po L. Tung, No. 20, Lane 673, Chung Cheng Rd., Tainan Hsien, Taiwan

[ * ] Notice: The portion of the term of this patent subsequent to Nov. 7, 2006 has been disclaimed.

[21] Appl. No.: 575,677

[22] Filed: Aug. 31, 1990

[51] Int. Cl.[5] ..... A45B 17/00

[52] U.S. Cl. ..... 135/20.3; 135/98

[58] Field of Search ..... 135/20 M, 24, DIG. 9, 135/98, 20 R, 20 A

[56] References Cited

U.S. PATENT DOCUMENTS

| | | | |
|---|---|---|---|
| 2,661,752 | 12/1953 | Kampf et al. | 135/98 X |
| 2,951,492 | 9/1960 | Small | 135/20 M |
| 3,129,715 | 4/1964 | Militano et al. | 135/20 M |
| 3,521,651 | 7/1970 | Pearlstine | 135/20 M X |
| 3,801,809 | 4/1974 | Slade | 135/20 M X |
| 4,582,078 | 4/1986 | Ma . | |
| 4,807,655 | 2/1989 | Robertson | 135/20 M X |
| 4,877,045 | 10/1989 | Lin | 135/20 M |
| 4,878,509 | 11/1989 | Tung . | |

FOREIGN PATENT DOCUMENTS

| | | | |
|---|---|---|---|
| 360467 | 4/1962 | Switzerland | 135/98 |

*Primary Examiner*—Richard E. Chilcot, Jr.
*Assistant Examiner*—Lan Mai
*Attorney, Agent, or Firm*—Morton J. Rosenberg; David I. Klein

[57] ABSTRACT

An improved tilting device for an umbrella includes an elongate connecting member connected to a control block, an upper bending head connected to an upper rod, and a lower bending head connected to a lower rod. The elongate connecting member has a pivot hole at the lower end. The upper bending head has a pair of downward extending plates each having a pinhole and an inclined slot. A spring member is mounted around the control block and the elongate connecting member. Each lateral side of the lower bending head is formed with a pinhole and an obtuse angular-shaped guide slot. The upper bending head is connected to the lower bending head and fixed in position by a pin. The lower end of the elongate connecting member is connected to the combination of the upper and lower bending head by a displacing pin extending through the guide slots, the inclined slots and the pivot hole. The upper and lower rods of the umbrella are connected and tiltable by the tilting device when a pull cord is pulled via three guide wheels to cause a runner to move upwards upon rotation of a crank handle; when the handle is further rotated, the control block is lowered along the upper rod and in the meantime, the connecting member together with the displacing pin moves along the guide slots of the lower bending head hence making the upper bending head to rotate about the pin.

3 Claims, 6 Drawing Sheets

STEPLESS TILTING DEVICE FOR UMBRELLA

BACKGROUND OF THE INVENTION

The present invention relates to an improved stepless tilting device for a large umbrella, such as beach or garden umbrella.

As is well known to those skilled in the art, relatively large umbrellas of the conventional beach, garden and lawn type incorporating tilting mechanisms are extremely difficult to operate due to their great weight, the force required to spread the canopy, and the force required to tilt the central rod. While umbrellas have been provided with operating devices employing mechanically advantageous mechanisms so as to reduce the required physical operating force, such devices have been subject to serious disadvantages. One problem common to the prior art devices was that of complex and expensive construction readily subject to malfunctioning. Another failing of the conventional umbrella-operating devices was the necessity for tedious and often skillful operating procedures, frequently consuming considerable time and requiring extraordinary dexterity.

U.S. Pat. No. 4,582,078 issued Apr. 15, 1986 to Ma entitled "Stepless Direction-Bending Device of the Central Rod for the Umbrella" discloses a stepless tilting mechanism which includes a carriage slidable on a hinged upper portion of the mast and which is moved axially against a spring bias after the umbrella has been opened. This arrangement allows the user to operate a linkage fast with the upper mast and which reacts against abutments provided on a fixed lower portion of the mast in order to effect tilting of the upper portion on the mast relative to the lower portion thereof.

The tilting mechanism made in accordance with the teaching of the Ma Patent is useful as it does not necessitate skillful operating procedures. However, the tilting mechanism of Ma still represents complex construction due to the use of links 24 and 25 (see FIG. 6) which are readily subject to deterioration and malfunctioning. In addition, the umbrella of Ma is not stable when it is placed in a vertical upright position due to the structure and combination of the links to other elements of the tilting mechanism.

U.S. Pat. No. 4,878,509 issued Nov. 7, 1989 to the inventor of the present invention entitled "Stepless Tilting Device for Umbrella" has obviated and mitigated the above-mentioned drawbacks.

To improve my previous tilting device such that the umbrella can be tilted with less force, the present invention has now been arisen.

SUMMARY OF THE INVENTION

It is a primary object of the present invention to provide a tilting device for an umbrella such that the direction of the umbrella can be changed more smoothly and easily.

A further object of the present invention is to provide a tilting device for an umbrella which requires less force to effect the tilting movement.

Another object of the present invention is to provide a tilting device for an umbrella which is more durable as less force is exerted on a pull cord which extends over guide wheels.

Another object of the present invention is to provide a tilting device for an umbrella which is provided with three guide wheels to facilitate the tilting movement.

These and other objects and advantages of the present invention will be apparent to those having ordinary skill in the art when the following detailed description of the preferred embodiment has been read in conjunction with the accompanying drawings.

DETAILED DESCRIPTION OF THE PREFERRED EMBODIMENT

Figure 1:
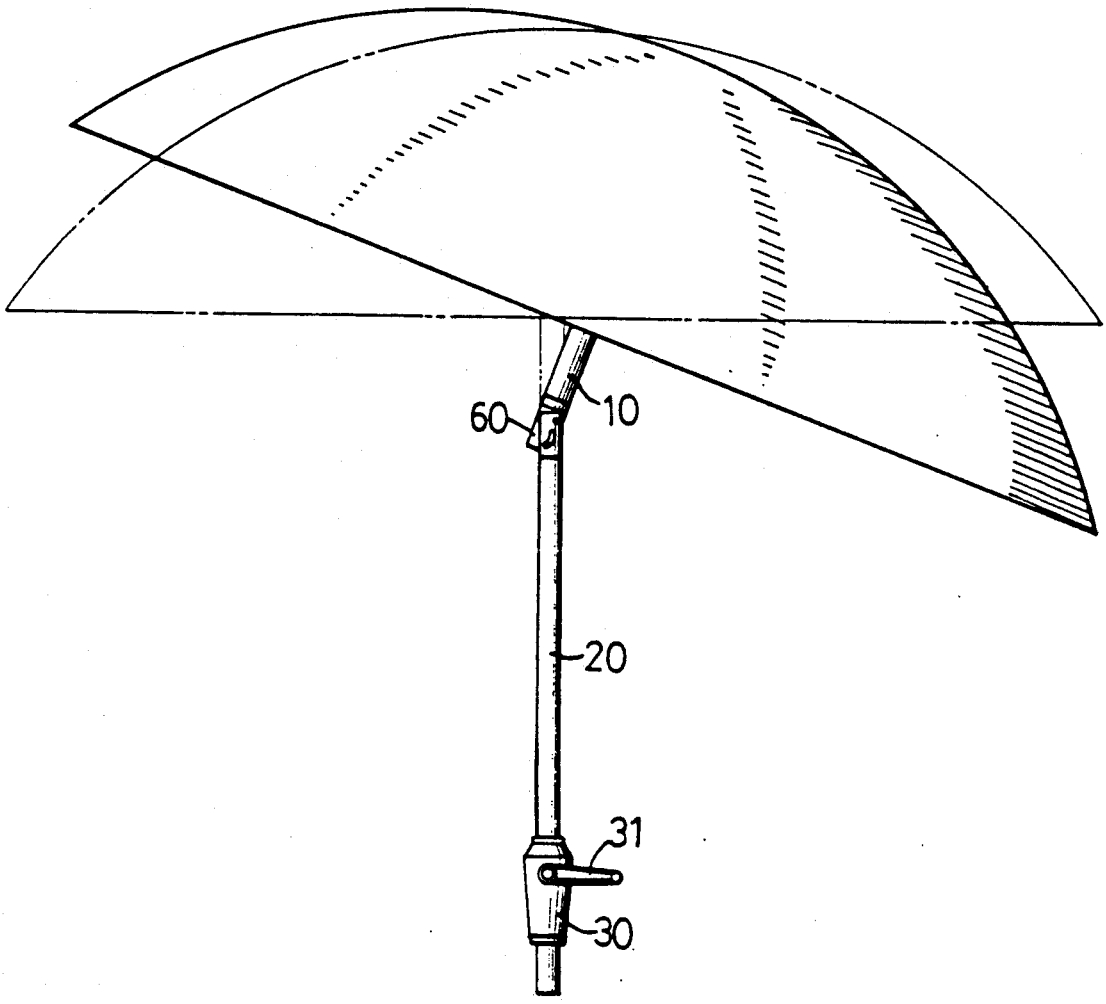
FIG. 1 is a diagrammatic illustration of an umbrella having a tilting device in accordance with the present invention.
Figure 3:
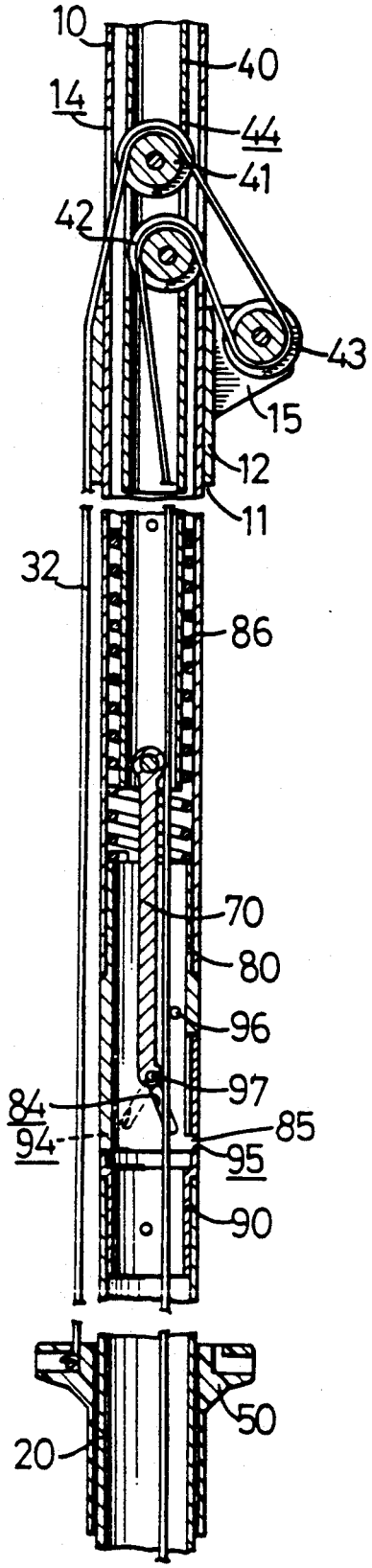
FIG. 3 is a cross-sectional view showing the tilting device of FIG. 1 in vertical upright position.

Referring to the drawings and initially to FIGS. 1 and 3, it can be seen that an umbrella in accordance with the present invention comprises an upper rod 10 that supports the umbrella, a lower rod 20 provided with a winch 30 engageable with a control block 40 to control the vertical movement of a runner 50 so as to open and close the umbrella. The upper rod 10 and the lower rod 20 are connected and tiltable by the incorporation of a tilting device 60 in accordance with the present invention.

When the crank handle 31 of the winch 30 is rotated, a pull cord 32 extending over guide wheels 41, 42 and 43 provided within an upper portion of the control block 40 and the upper rod 10, causes the runner 50 to move upwards to a lower edge 11 of an integrally formed collar 12, thus causing the support ribs (not shown) carried by the runner 50 to extend the umbrella to its open form.

Figure 4:
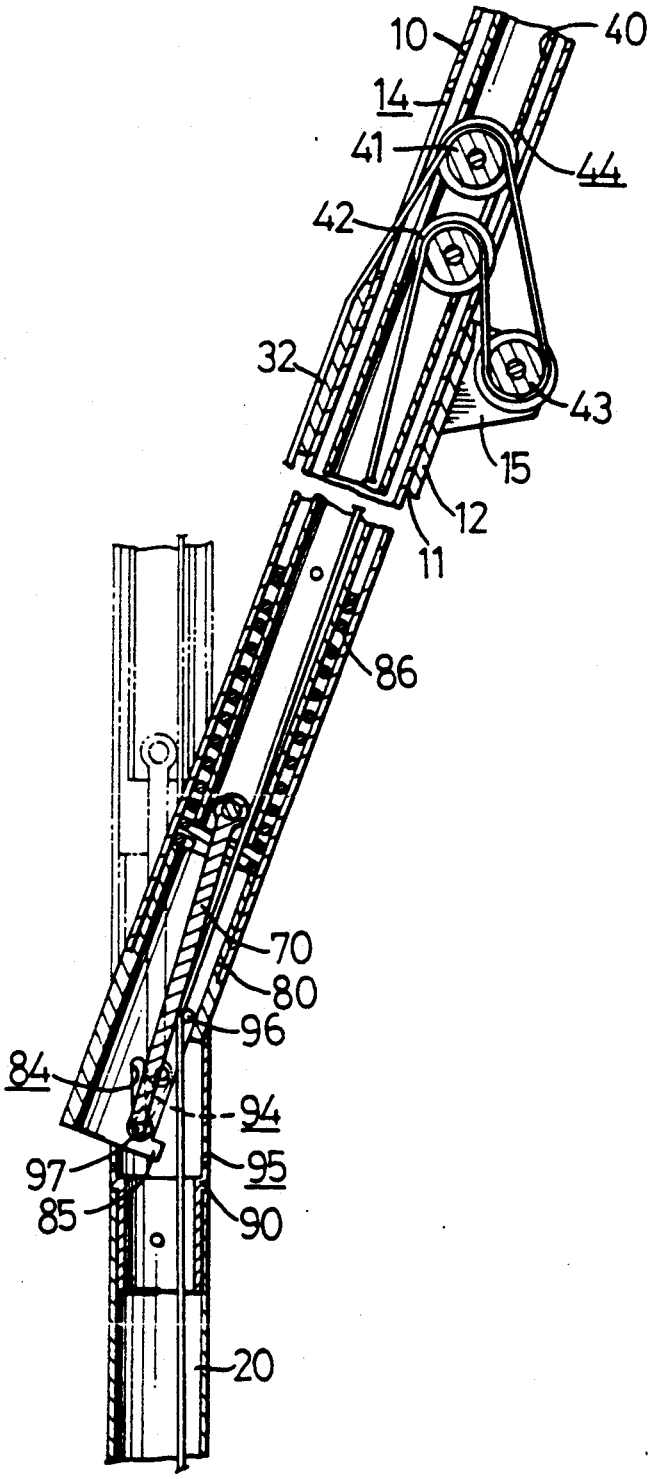
FIG. 4 is a cross-sectional view showing the tilting device of FIG. 1 in tilted position.

After the umbrella is opened, continued rotation of the crank handle 31 of the winch 30 causes the runner 50 to actuate the tilting device 60 and causes the upper rod 10 to tilt with respect to the lower rod 20, as in FIG. 4.

Figure 2:
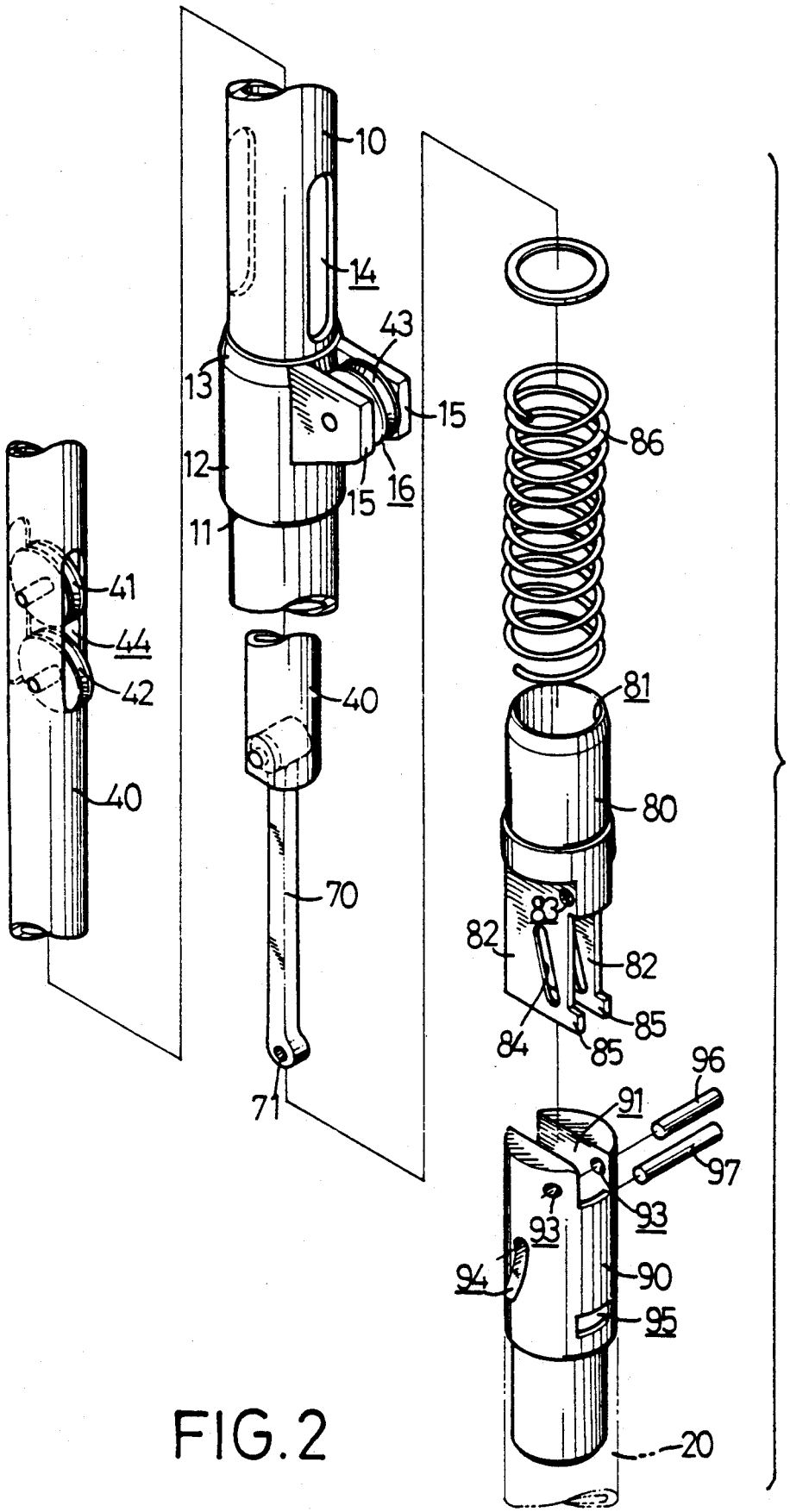
FIG. 2 is an exploded view showing the structure of the tilting device of the present invention.

Referring particularly to FIG. 2, it can be seen that the tilting device 60 comprises an elongate connecting member 70 connected to a lower end of the control block 40, an upper bending head 80 connected to a lower end of the upper rod 10, and a lower bending head 90 connected to an upper end of the lower rod 20.

The control block 40 is disposed within the upper rod 10. At an upper portion of the control block 40, two elongated slots 44 in alignment with each other are formed to receive the two guide wheels 41 and 42, with the first guide wheel 41 located at an upper position and the second guide wheel 42 located at a lower position.

The upper rod 10, as has been mentioned previously, is provided with an integrally formed collar 12. The lower edge 11 of the collar 12 serves to stop the runner 50 from moving further upwards, thus causing the support ribs to extend the umbrella to its open form. The upper edge 13 of the collar 12 is formed in a slanted manner. The upper rod 10 is also provided with two aligned elongated slots 14 corresponding to the elongated slots 44 of the control block 40 once assembled. Two spatial outward extending walls 15 extend from the outer surface of the collar 12 to define a slot 16 for receiving the third guide wheel 43.

One of the important feature of the present invention resides in the provision of three guide wheels 41, 42 and 43, instead of one guide wheel, so that the umbrella can be tilted with less force during tilting operation. It should therefore be noted that the three guide wheels 41, 42 and 43 are all provided on a same longitudinal plane so that the pull cord 32 can extend thereover. The first and the second guide wheels 41 and 42 can be fixed within the control block 40 and the upper rod 10 by any suitable conventional means provided that the guide wheels 41 and 42 can rotate freely. Also, the third guide wheel 43 can be fixed within the two spacial walls 15 by any suitable conventional means provided that the guide wheel 43 can rotate freely.

The elongate connecting member 70, which is connected to the lower end of the control block 40 by any suitable connection, comprises at a lower end thereof a pivot hole 71 therethrough for pivot movement which will be described more fully hereinbelow.

The upper bending head 80, which is a sleeve body connected to the lower end of the upper rod 10 by any suitable connection, comprises a central opening 81 for the passage of the elongate connecting member 70 and a pair of downward extending plates 82. Each downward extending plate 82 includes a pinhole 83 and an inclined slot 84. The pinhole 83 and the inclined slot 84 of one downward extending plate 82 are in transverse alignment with the pinhole 83 and the inclined slot 84 of the other downward extending plate 82. Each downward extending plate 82 further includes a lateral extending leg 85 at a lower side thereof.

A spring member 86 (see FIGS. 2, 3 and 4) is mounted around the control block 40 and the elongate connecting member 70 within the hollow upper rod 10 and is located against the upper bending head 80. The upper bending head 80 is urgable by the spring member 86.

The lower bending head 90, which is a sleeve body connected to the upper end of the lower rod 20 by any suitable connection, comprises a central recess 91 at an upper end thereof for receiving said pair of downward extending plates 82. On each of the two lateral sides of the lower bending head 90, there is formed a pinhole 93 and a guide slot 94 therethrough. The pinhole 93 and the guide slot 94 formed on one lateral side are in transverse alignment with the pinhole 93 and the guide slot 94 of the other lateral side. Each guide slot 94 has an obtuse angular shape. The lower bending head 90 further includes an opening 95 at a side thereof corresponding to the location of the lateral extending legs 85 once assembled.

The downward extending plates 82 of the upper bending head 80 are received in the central recess 91 of the lower bending head 90 and fixed in position by a pin 96. The pin 96 passes through the pinholes 83 of the upper bending head 80 and the pinholes 93 of the lower bending head 90. Upper and lower bending heads 80 and 90 are thus connected. The lateral extending legs 85 of the upper bending head 80 are retained within the opening 95 of the lower bending head 90, when the upper and lower bending heads 80 and 90 are held in vertical position. The legs 85 depart from the opening when the gore of the umbrella is being tilted.

As has been mentioned previously, the lower end of the elongate connecting member 70 is disposed between the downward extending plates 81 of the upper bending head 80. The elongate connecting member 70 is connected to the combination of the upper and lower bending head 80 and 90 by means of a displacing pin 97 extending through the guide slots 94 of the lower bending head 90, the inclined slots 84 of the upper bending head 80 and the pivot hole 71 of the elongate connecting member 70.

Hence, when the pull cord 32 pulls up the runner 50 via the guide wheels 41, 42 and 43, the runner 50 is first urged against the collar 12. If the pull cord 32 is further pulled, the whole control block 40 is urged down to compress the spring member 86.

Conversely, when the pull cord 32 is released, the spring member 86 is restored thus pushing up the control block 40 to its original position.

Figure 5:
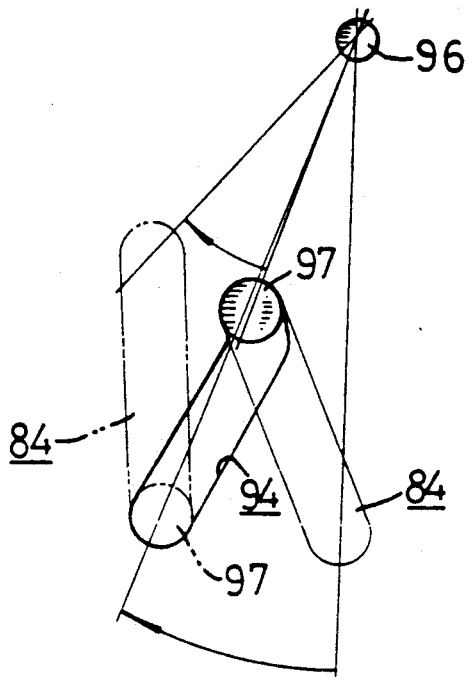
FIG. 5 is a schematic view showing the tilting movement of an upper bending head with respect to a lower bending head.
Figure 6:
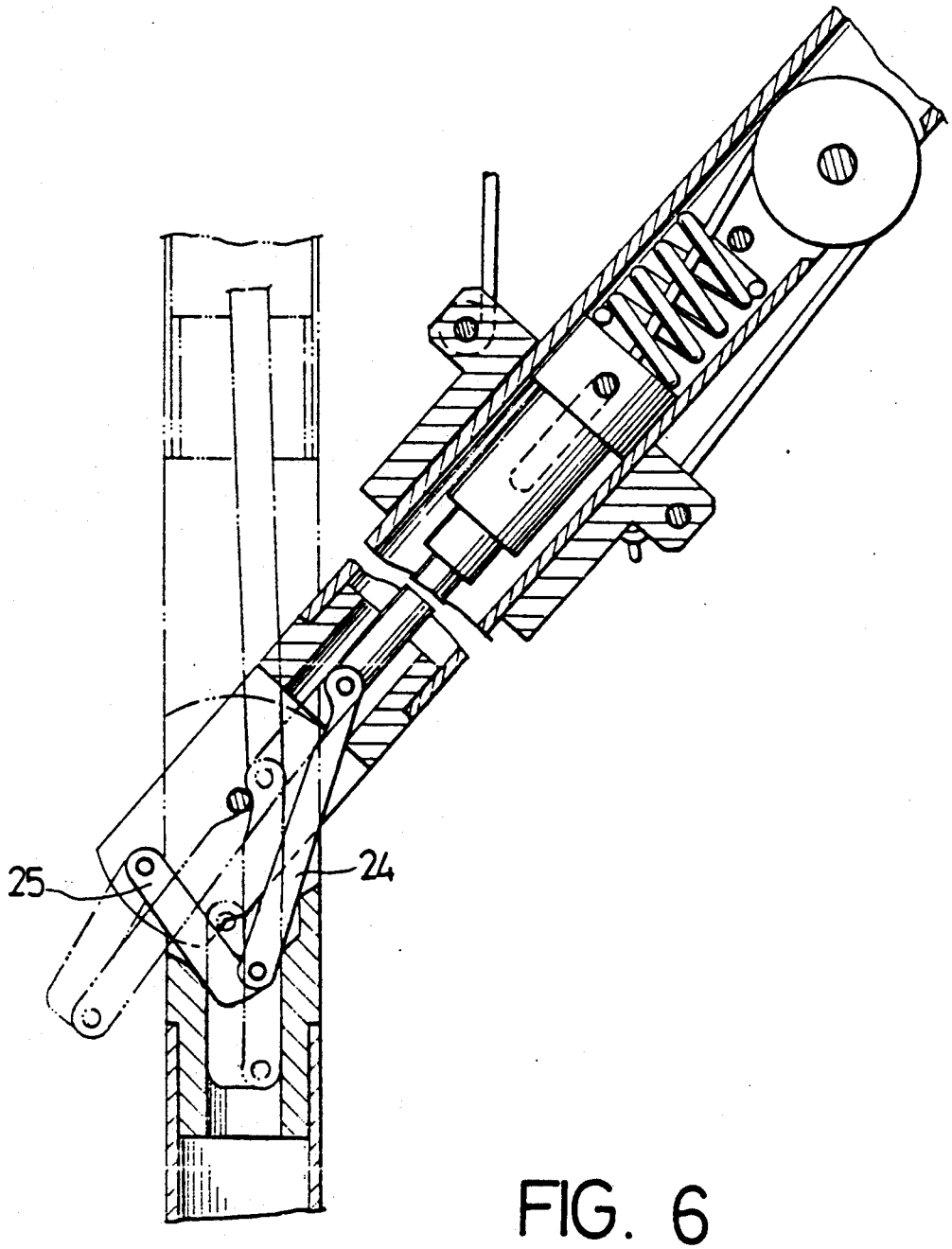
FIG. 6 PRIOR ART
FIG. 6 is a cross-sectional view through the upper and lower mast sections of an umbrella showing a conventional tilting mechanism.

With particular reference to FIGS. 4 and 5, the upper bending head 80 tilts pivotally at the pin 96 with respect to the lower bending head 90, while the displacing pin 97 is limited within the pivot hole 71 of the elongate connecting member 70. In short, at the same time as the control block 40 is lowered to compress the spring member 86, the displacing pin 97 moves along the guide slot 94 of the lower bending head 90.

Since the guide slot 94 has an obtuse angular shape, the upper bending head 80 will turn steplessly from an initial vertical position in phantom line to a critical tilted position in solid line, as shown in FIG. 4. Also, the upper bending head 80 can be tilted and kept at any positions if the control block 40 is not lowered to compress the spring member 86 any further.

In operation, when the crank handle 31 is rotated, the pull cord 32 is pulled via the first guide wheel 41, the third guide wheel 43, and the second guide wheel 42 consecutively, thereby causing the runner 50 to move upwards and engage with the collar 12. When the crank handle 31 is further rotated to pull the pull cord 32, then the control block 40 is lowered along the upper rod 10. Meanwhile, the elongate connecting member 70 together with the displacing pin 97 move along the guide slot 94 of the lower bending head 90 hence causing the upper bending head 80 to rotate about the pin 96, and therefore, changing the direction of the gore.

As has been mentioned previously, when the pull cord 32 is released, the spring member 86 is restored such that the control block 40 moves up to its original position, thereby causing the upper bending head 80 and the lower bending head 90 to return to their vertical positions.

Although this invention has been described in relation to its preferred embodiment, it is understood that the present disclosure is made by way of example only and that numerous changes in the construction and the combination and arrangement of parts may be resorted to without departing from the spirit and scope of the invention as hereinafter claimed.

I claim:

1. A tilting device for an umbrella comprising:

a control block (40) received in an upper rod (10) of the umbrella, said control block (40) having two elongated slots (44) in alignment with each other at an upper end portion thereof to receive two guide wheels (41) and (42); said upper rod (10) having two aligned elongated slots (14) corresponding to said elongated slots (44) of said control block (40) and two spatial outwardly extending walls (15) extend from the outer surface thereof to define a slot (16) for receiving a third guide wheel (43); said three guide wheels (41), (42) and (43) being provided on a same longitudinal plane;

a pull cord (32) connecting a winch (30) with a runner (50) of the umbrella via said guide wheels (41), (42) and (43), said winch (30) being controllable by a crank handle (31);

an elongate connecting member (70) connected to a lower end of said control block (40), said elongate connecting member (70) including a pivot hole (71) at a lower end therethrough;

an upper bending head (80) being a sleeve body connected to said upper rod (10), said upper bending head (80) including a central opening (81) for the passage of said elongate connecting member (70) and a pair of downward extending plates (82), each downward extending plate (82) having a pinhole (83) and an inclined slot (84) therethrough, said pinhole (83) and said inclined slot (84) of one downward extending plate (82) being in transverse alignment with said pinhole (83) and said inclined slot (84) of the other downward extending plate (82);

a spring member (86) mounted around said control block (40) and said elongate connecting member (70);

a lower bending head (90) being a sleeve body connected to a lower rod (20) of the umbrella, said lower bending head (90) including a central recess (91) at an upper end thereof for receiving said pair of downward extending plates (82), each lateral side of said lower bending head (90) being formed with a pinhole (93) and a guide slot (94) therethrough, said pinhole (93) and said guide slot (94) formed on one lateral side being in transverse alignment with said pinhole (93) and said guide slot (94) of the other lateral side, each guide slot (94) having an obtuse angular shape;

a pin (96) extending through the pinholes (83), (93) for pivotally connecting said upper bending head (80) and said lower bending head (90);

a displacing pin (97) extending through said guide slots (94), said inclined slots (84) and said pivot hole (71) for connecting said elongate connecting member (70) to said upper bending head (80) and said lower bending head (90);

whereby said pull cord (32) is pulled via said the first guide wheel (41), the third guide wheel (43) and the second guide wheel (42) consecutively, thereby causing said runner (50) to move upwards and engage with a collar (12) of the umbrella when said crank handle (31) is rotated; said control block (40) is lowered along said upper rod (10) when said crank handle (31) is further rotated to pull said pull cord (32) and in the meantime, said elongate connecting member (70) together with said displacing pin (97) are movable along said guide slots (94) so that said upper bending head (80) rotates pivotally about said pin (96) to tilt said upper rod (10) with respect to said lower rod (20); said spring member (86) is restored so that said control block (40) moves up to an original position thereof thus causing said upper bending head (80) and said lower bending head (90) to return to vertical positions thereof when said pull cord (32) is released.

2. A tilting device as claimed in claim 1, wherein each downward extending plate (82) further includes a lateral extending leg (85) at a lower side thereof.

3. A tilting device as claimed in claim 2, wherein said lower bending head (90) further includes an opening (95) at a side thereof corresponding to the location of the lateral extending legs (85).

* * * * *